US006237570B1

(12) United States Patent
Aoki et al.

(10) Patent No.: US 6,237,570 B1
(45) Date of Patent: May 29, 2001

(54) ACCUMULATOR FUEL INJECTION APPARATUS

(75) Inventors: Hiromasa Aoki, Nagoya; Hisaharu Takeuchi, Tokoname; Ken Uchiyama, Kariya; Masato Nakagawa, Aichi-ken; Yukinori Miyata, Kariya; Shuichi Matsumoto, Kariya; Masatoshi Kuroyanagi, Kariya; Shinji Ueda, Anjo, all of (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 09/166,576

(22) Filed: Oct. 6, 1998

(30) Foreign Application Priority Data

Oct. 9, 1997 (JP) ..... 9-293454
Oct. 31, 1997 (JP) ..... 9-316132

(51) Int. Cl.[7] ..... F02M 37/04
(52) U.S. Cl. ..... 123/467; 123/458
(58) Field of Search ..... 123/467, 516, 123/447, 458

(56) References Cited

U.S. PATENT DOCUMENTS 4,603,671 * 8/1986 Yoshinaga ..... 123/467
4,784,101 * 11/1988 Iwanaga ..... 123/467
5,156,132 * 10/1992 Iwanaga ..... 123/467
5,201,295 * 4/1993 Kimberley ..... 123/467
5,408,970 * 4/1995 Burkhard ..... 123/467
5,694,903 * 12/1997 Ganser ..... 123/467
5,732,679 * 3/1998 Takahasi ..... 123/467
5,803,369 9/1998 Toyao et al. .

FOREIGN PATENT DOCUMENTS 9-42106 2/1997 (JP) .

* cited by examiner

*Primary Examiner*—Carl S. Miller
(74) *Attorney, Agent, or Firm*—Nixon & Vanderhye PC

(57) ABSTRACT

Pressurized fuel of a common rail is introduced into a control chamber of a fuel injector. An electromagnetic valve opens or closes a fuel discharge passage of the control chamber to adjust a hydraulic pressure of the control chamber. Through a switching leak passage, bubble-containing fuel directly returns from a valve opening of the electromagnetic valve to a low-pressure return passage without passing through an armature chamber. Through a stationary leak passage, the fuel leaking from every slide portion returns to the return passage via the armature chamber. A downstream portion of the stationary leak passage opens to the upper portion of the armature chamber. A damper element is provided downstream of the electromagnetic valve in the return passage for canceling an increased fuel pressure.

16 Claims, 10 Drawing Sheets

ACCUMULATOR FUEL INJECTION APPARATUS

BACKGROUND OF THE INVENTION

The present invention relates to an accumulator fuel injection apparatus.

An accumulator fuel injection apparatus, generally known as a common rail type fuel injection apparatus, is preferably used to inject fuel into a diesel engine. According to the accumulator fuel injection apparatus, a common accumulator piping (i.e., common rail) is provided to supply fuel to each cylinder of the engine. A supply pump is provided to supply pressurized fuel into this common rail so that a hydraulic pressure of the fuel in the common rail is maintained at a predetermined level. The accumulated fuel of the common rail is introduced into each fuel injector via a fuel supply pipe.

The accumulated fuel supplied to the fuel injector is chiefly injected into a combustion chamber of each cylinder. However, part of the accumulated fuel is used to control the fuel injector. This kind of control fuel is introduced into a control chamber. An electromagnetic valve opens or closes a fuel discharge passage of the control chamber to adjust a hydraulic pressure of the control chamber. The control chamber controls opening and closing of a needle valve that determines injection and shutoff periods of the fuel injector. The electromagnetic valve discharges the fuel from its valve opening to a lowpressure return passage via a switching leak passage. Furthermore, when the fuel leaks from any slide portion of the fuel injector, the fuel returns via a stationary passage to the low-pressure return passage.

The electromagnetic valve has an armature driven by a solenoid to open-and-close control the valve opening of the electromagnetic valve. The armature is accommodated in an armature chamber. This armature chamber is filled with the fuel to stabilize the operation of the armature. As an arrangement for introducing the fuel into the armature chamber, the armature chamber may be located downstream of the valve opening of the electromagnetic valve in the switching leak passage, as disclosed in the published Japanese Patent Application No. Kokai 9-42106, corresponding to the U.S. Pat. No. application Ser. No. 08/686,774.

However, when incorporated into recent advanced engines, the above-described fuel injection apparatus cannot satisfy various requirements for realizing precise engine controls. More specifically, a great amount of bubbles are generated in the vicinity of a valve opening of the electromagnetic valve when the hydraulic pressure of the accumulated fuel in the control chamber abruptly reduces to a lower value in response to the valve opening operation. The generated bubbles enter the armature chamber. When the armature chamber is filled with bubble-containing fuel, the armature does not operate stably. Furthermore, the fuel leak amount varies depending on engine operating conditions, causing changes in the hydraulic pressure of the armature chamber and in the bubble amount so that the operation varies in a complicated manner. When realizing the precise engine controls, such unstable operation of the armature (i.e., open and close control of the electromagnetic valve) will cause various problems including fluctuation of the fuel injection amount with respect to a set value.

According to another conventional method of introducing the fuel into the armature chamber, it is possible to form a dead alley branching from the switching leak passage at a portion just downstream of a valve opening of the electromagnetic valve. The armature chamber is provided at the dead end of this alley so as to prevent bubbles generated at the valve opening of the electromagnetic valve from directly entering the armature chamber. However, this arrangement is disadvantageous in that air may enter the armature chamber during installation and the residual air in the armature chamber cannot be discharged easily. This sensitively changes environment of the armature depending on the engine operating conditions. The armature is soaked in the fuel in some cases and exposed to the air in other cases. This is not preferable in realizing accurate engine control.

Furthermore, according to the above-described accumulator fuel injection apparatus, when the needle valve is closed, a hydraulic pressure of the armature chamber changes abruptly. Operation of the electromagnetic valve is not stabilized. FIG. 14 shows a variation of a valve lift amount relative to elapse of time. Due to unstable operation of the electromagnetic valve, the needle valve causes a large bounce after the needle valve is once seated to stop the fuel supply. Such a bouncing behavior of the needle valve causes a significant delay in the shutoff operation of the fuel injection. As a result, an actual fuel injection amount exceeds a set value predetermined based on engine operating conditions, such as engine load or the like. The valve bouncing behavior is not constant and variable depending on engine operating conditions as well as individual differences of needle valves. Accordingly, as a matter of practical problem, correcting the error caused between the actual fuel injection amount and the set value is difficult. The engine controls cannot be accurately performed.

SUMMARY OF THE INVENTION

In view of the problems encountered in the prior art, an object of the present invention is to provide an accumulator fuel injection apparatus which is capable of stabilizing the armature operation of the electromagnetic valve and realizing accurate engine controls.

Another object of the present invention is to provide an accumulator fuel injection apparatus which is capable of suppressing the valve bouncing behavior during a valve closing operation, thereby realizing accurate engine controls.

In order to accomplish this and other related objects, the present invention provides an accumulator fuel injection apparatus comprising a fuel injector, an accumulator pipe for supplying pressurized fuel to the fuel injector, a control chamber for open-and-close controlling a needle valve that determines injection and shutoff periods of the fuel injector, an electromagnetic valve for adjusting a hydraulic pressure of the control chamber, and a stabilizing means provided for stabilizing behavior of the fuel used to control the fuel injector.

Preferably, the electromagnetic valve comprises an armature driven by a solenoid to open-and-close control a valve opening of the electromagnetic valve. The armature is accommodated in an armature chamber into which the fuel is introduced. And, the stabilizing means is a passage for discharging bubbles or residual air from the armature chamber.

Preferably, the stabilizing means is a damper element provided in a return passage which returning part of the pressurized fuel from the fuel injector to a fuel tank via a return pipe. The damper element is provided at a portion downstream of the electromagnetic valve for suppressing increase in a hydraulic pressure of fuel flowing in the return passage.

According to one aspect of the present invention, the fuel injector introduces part of accumulated fuel into a control chamber to open-and-close control a needle valve according to a hydraulic pressure of the introduced fuel. The needle valve determines injection and shutoff periods of the fuel injector. An electromagnetic valve opens and closes a fuel discharge passage of the control chamber to adjust a hydraulic pressure in the control chamber, thereby opening or closing the needle valve. The fuel injector comprises a switching leak passage for returning discharged fuel from a valve opening of the electromagnetic valve to a low-pressure return passage, and a stationary leak passage for returning fuel leaking from slide portions of the fuel injector to the low-pressure return passage. The electromagnetic valve comprises an armature chamber for accommodating an armature driven by a solenoid to open-and-close control the valve opening of the electromagnetic valve. The fuel is introduced into the armature chamber. Furthermore, the switching leak passage directly connects the valve opening of the electromagnetic valve and the low-pressure return passage. The armature chamber is provided in the stationary leak passage. A downstream portion of the stationary leak passage positioned downstream of the armature chamber communicates with an upper portion of the armature chamber.

The fuel flowing in the switching leak passage may contain a great amount of bubbles generated at the valve opening of the electromagnetic valve. However, as the valve opening of the electromagnetic valve directly communicates with the return passage, the bubbles move toward the return passage without directly entering the armature chamber.

The residual air contained in the armature chamber during installation of the apparatus moves to the upper portion of the armature chamber when the leaking fuel starts flowing into the stationary leak passage. As the downstream portion of the stationary leak passage is connected to the upper portion of the armature chamber, the air exits out of the armature chamber and moves to the downstream portion of the stationary leak passage. The armature chamber is filled with fuel so that the armature is not exposed to air.

The fuel leaking from each slide portion contains few bubbles. In the armature chamber, few bubbles are generated. Accordingly, after moving to the upper portion of the armature chamber, the bubbles quickly exit out of the armature chamber and come to the downstream portion of the stationary leak passage in the same manner as the above-described residual air.

Thus, the armature movement is stabilized and the electromagnetic valve operates appropriately.

Preferably, the downstream portion of the stationary leak passage is connected to a ceiling opening of the armature chamber which is located at the highest point of the armature chamber. With this arrangement, the residual air and the bubbles can smoothly exit out of the armature chamber to the downstream portion of the stationary leak passage.

Preferably, the stationary leak passage has a check valve provided between the armature chamber and a merging portion to the switching leak passage for limiting flow of the fuel in a single direction directing from the armature chamber to the merging portion.

The provision of the check valve surely prevents the bubble-containing fuel from flowing into the armature chamber from the switching leak passage. Thus, it becomes possible to eliminate the adverse influence of the bubbles generated at the valve opening of the electromagnetic valve.

According to another aspect of the present invention, pressurized fuel is supplied to the fuel injector from the accumulator pipe. A return passage is provided for returning part of the pressurized fuel from the fuel injector to a fuel tank via a return pipe. A control chamber is provided in the return passage for open-and-close controlling the needle valve that determines injection and shutoff periods of the fuel injector. An electromagnetic valve is provided downstream of the control chamber for controlling communication and isolation between the control chamber and the return pipe. And, a damper element is provided in the return passage at a portion downstream of the electromagnetic valve for suppressing increase in a hydraulic pressure of fuel flowing in the return passage.

According to this arrangement, the damper element suppresses the increase in the hydraulic pressure of the fuel flowing in the downstream portion of the electromagnetic valve, eliminating fluctuation of fuel pressure in the fuel injector and stabilizing operation of the electromagnetic valve. Thus, the bouncing phenomenon of the needle valve is eliminated, and accurate engine control is realized.

Preferably, the damper element comprises a pressure-receiving plate facing the return passage and retractable in response to the increase of hydraulic pressure of the fuel flowing in the return passage.

When the pressure-receiving plate shifts backward, a substantial volume of the downstream portion of the return passage increases so as to cancel the increase of the fuel pressure.

Preferably, the damper element is accommodated in a connection member connecting the fuel injector and the return pipe. The connection member constitutes part of the return passage.

The connection member is located just downstream of the fuel injector, and therefore the connection member is closer to the electromagnetic valve. This arrangement allows the damper element accommodated in the connection member to quickly increase the downstream volume of the return passage in response to the increased fuel pressure. Thus, the valve bouncing behavior can be effectively eliminated. The damper element can be easily accommodated in the connection member. Thus, the present invention requires no design modification in the overall arrangement of the apparatus.

Preferably, the connection member comprises a cylindrical housing connected to the fuel injector at one end. The cylindrical housing has at least one through hole formed on a cylindrical wall for communicating an inside space of the cylindrical housing with the return pipe. The damper element comprises a pressure-receiving plate made of a resiliently deflectable thin plate disposed normal to an axis of the cylindrical housing to close the other end of the cylindrical housing.

By simply closing the other end of the housing with the pressure-receiving plate, the damper element can be easily constituted. Furthermore, the increase of the fuel pressure can be effectively canceled because the pressure-receiving plate is disposed normal to the axial direction corresponding to the flow direction of the fuel in the housing.

Preferably, two pairs of through holes are provided at symmetrical positions on the cylindrical housing corresponding to radial lines crossing normal to each other. The two pairs of through holes are offset in an axial direction of the cylindrical housing.

The symmetrical arrangement of the through holes realizes uniform fuel flow in the cylindrical housing, stabilizing operation of the pressure-receiving plate when the fuel pressure is increased. The axial offset arrangement of the through holes makes it possible to adequately separate the opened or lightened portions in the axial direction, thereby maintaining the strength of the housing at a sufficient value.

Another aspect of the present invention provides an accumulator fuel injection apparatus for supplying accumulated fuel from an accumulator pipe to a fuel injector. The fuel injector comprises a control chamber into which part of the accumulated fuel is introduced to open-and-close control a needle valve according to a hydraulic pressure of the introduced fuel, the needle valve determining injection and shutoff periods of the fuel injector, an electromagnetic valve provided downstream of the control chamber for opening and closing a fuel discharge passage of the control chamber to adjust a hydraulic pressure in the control chamber, a switching leak passage for returning the discharged fuel from a valve opening of the electromagnetic valve to a low-pressure return passage, and a stationary leak passage for returning fuel leaking from slide portions of the fuel injector to the low-pressure return passage. The electromagnetic valve comprises an armature chamber for accommodating an armature driven by a solenoid to open-and-close control the valve opening of the electromagnetic valve, and the fuel is introduced into the armature chamber. The switching leak passage directly connects the valve opening of the electromagnetic valve and the low-pressure return passage. The armature chamber is provided in the stationary leak passage. A downstream portion of the stationary leak passage, positioned downstream of the armature chamber, communicates with an upper portion of the armature chamber. And, a damper element is provided in the return passage at a portion downstream of the electromagnetic valve for suppressing increase in a hydraulic pressure of fuel flowing in the return passage.

BRIEF DESCRIPTION OF THE DRAWINGS

The above and other objects, features and advantages of the present invention will become more apparent from the following detailed description which is to be read in conjunction with the attached drawings, in which.

DESCRIPTION OF THE PREFERRED EMBODIMENTS

Figure 1:
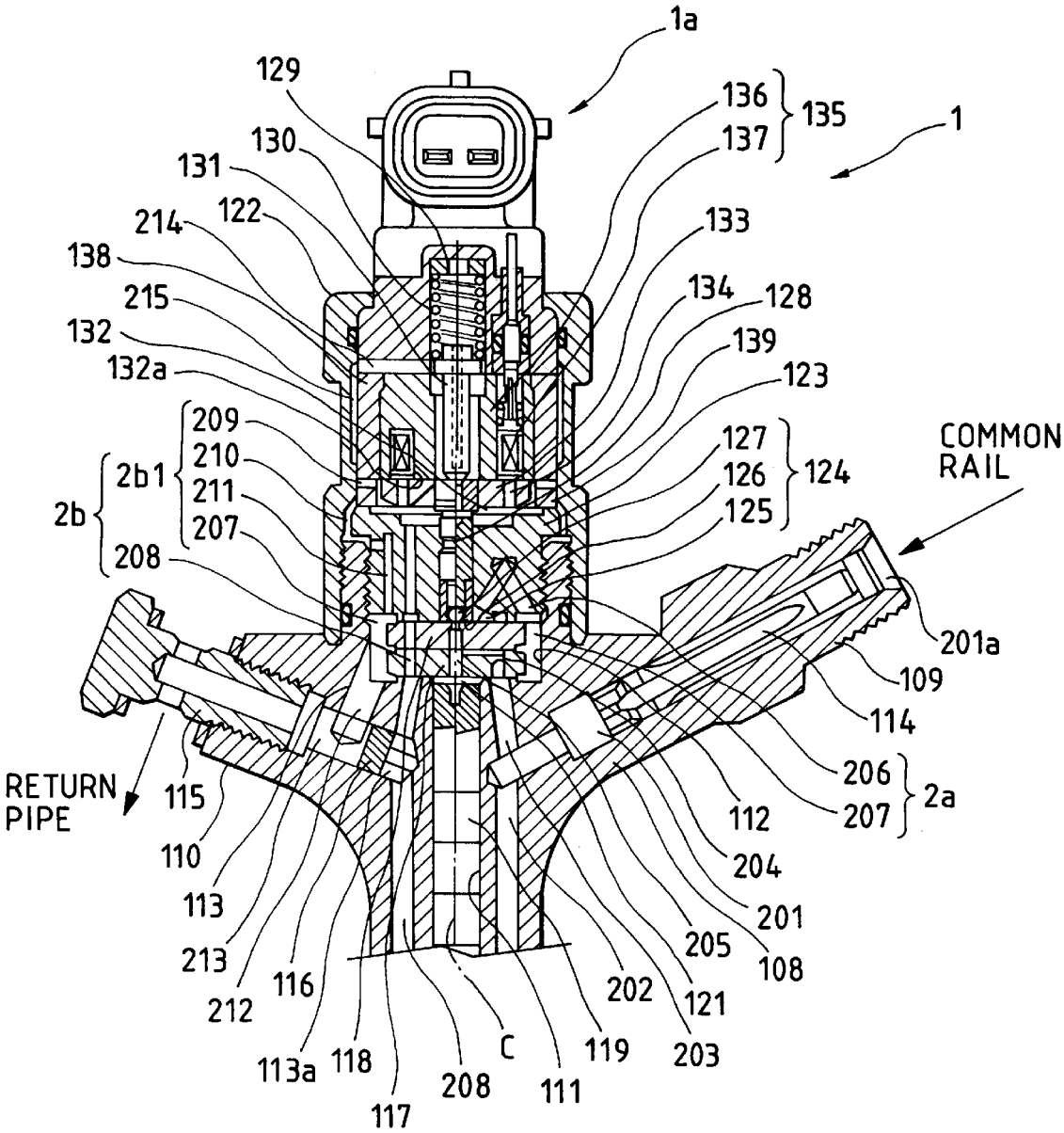
FIG. 1 is vertical cross-sectional view showing an essential arrangement of a fuel injector in accordance with a first embodiment of the present invention, employed in an accumulator fuel injection apparatus.

Preferred embodiments of the present invention will be explained hereinafter with reference to the attached drawings. Identical parts are denoted by the same reference numerals throughout the views.

Overall Arrangement

Figure 2:
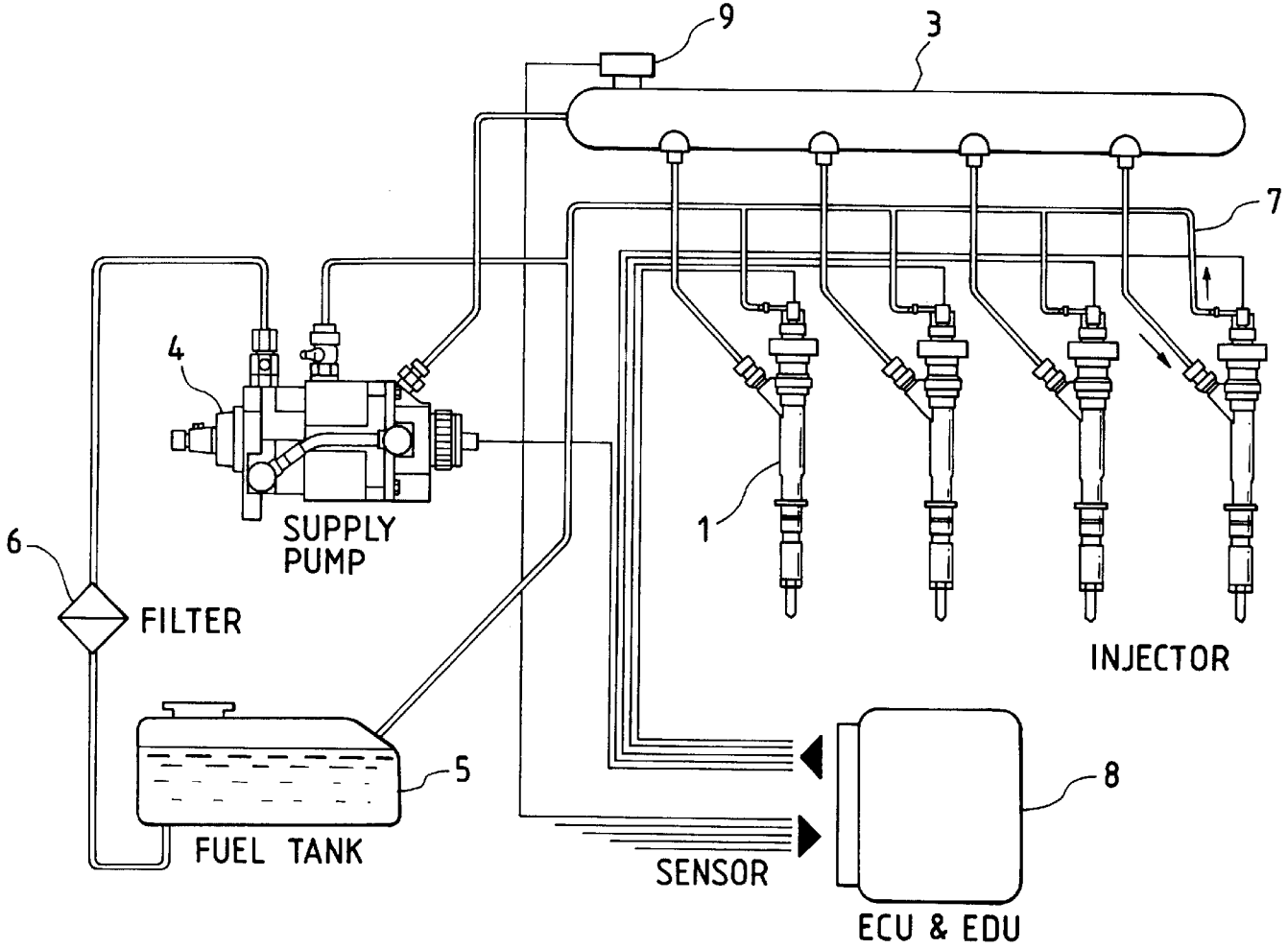
FIG. 2 is a schematic view showing an overall arrangement of the accumulator fuel injection apparatus embodying the present invention.

FIG. 2 is a schematic view showing an overall arrangement of an accumulator fuel injection apparatus embodying the present invention. A plurality of injectors 1, corresponding to combustion chambers of respective cylinders of an engine (not shown), are provided. A common rail 3 common to all cylinders is connected to these injectors 1 to supply pressurized fuel. A supply pump 4 is connected to the common rail 3. Low-pressure fuel is supplied to this supply pump 4 from a fuel tank 5 via a filter 6. The supply pump 4 pressurizes the introduced fuel to a predetermined high level corresponding to a fuel injection pressure, thereby accumulating the pressurized fuel in the common rail 3.

The accumulated fuel supplied to the fuel injector 1 is chiefly injected into a corresponding combustion chamber. However, part of the accumulated fuel is used to control opening and closure of the fuel injector 1. The control fuel returns to the fuel tank 5 via a return pipe 7 together with surplus fuel of the fuel injector 1 and the supply pump 4.

An electronic control unit (i.e., ECU) 8, associated with an electronic drive unit (i.e., EDU) for driving the fuel injector 1, controls the fuel injector 1. The ECU 8 receives a signal of a pressure sensor 9 that detects the hydraulic pressure of the common rail 3. The ECU 8 controls a fuel supply amount of the supply pump 4 so as to equalize the hydraulic pressure of the common rail 3 to an optimum value which is pre-determined in accordance with the engine load and the engine speed. Furthermore, the ECU 8 receives signals obtained from various sensors, such as an engine speed sensor and an engine load sensor, to judge the engine operating conditions. The ECU 8 determines an optimum injection timing and an optimum injection amount (i.e., injection period of time) in accordance with the detected engine operating conditions, and generates a control signal. In response to this control signal, the fuel injector 1 injects the fuel into a corresponding chamber at the optimum timing with the optimum injection amount.

First Embodiment

Figure 3:
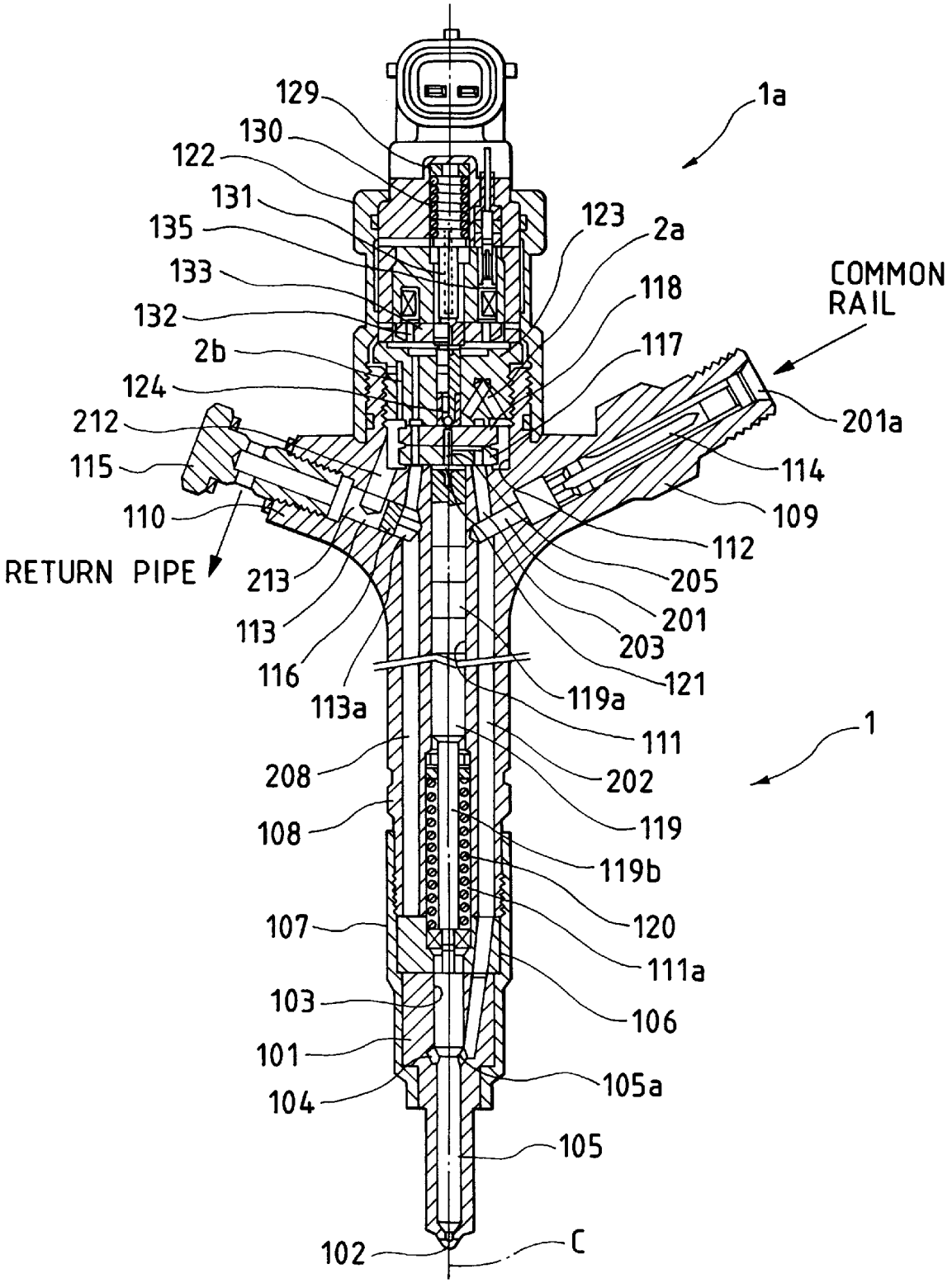
FIG. 3 is a vertical cross-sectional view showing an overall arrangement of the fuel injector in accordance with the first embodiment of the present invention.

FIG. 1 is a vertical cross-sectional view showing an essential arrangement of the fuel injector 1, employed in the accumulator fuel injection apparatus shown in FIG. 2. FIG. 3 is a vertical cross-sectional view showing an overall arrangement of the fuel injector 1. The fuel injector 1 comprises a rodlike nozzle holder 108. A nozzle body 101 is provided below the nozzle holder 108 via a distance piece 106 and fastened by a nozzle retaining nut 107. The nozzle body 101 has a fuel injection hole 102 opened at the distal end thereof. An electromagnetic valve 1*a*, determining fuel injection and shutoff periods, is provided above the nozzle holder 108. The electromagnetic valve 1*a* opens or closes its valve opening in response to a control signal supplied from the ECU 8 (refer to FIG. 2).

The nozzle holder 108 has an inlet portion 109 and a return portion 110 each extending obliquely upward. The inlet portion 109 is connected to the common rail 3 (refer to FIG. 2). An inlet passage 201 is formed in the inlet portion 109. A bar filter 114 is provided in this inlet passage 201 at a portion downstream of an inlet opening 201*a*. The bar filter 114 removes foreign substances contained in the accumulated fuel introduced from the common rail 3. A deep hole 113 is formed in the return portion 110. A hollow screw 115, screwed in the return portion 110, connects the return portion 110 and the return pipe 7 (refer to FIG. 2). A disc member 116 is placed at the bottom of the deep hole 113. A portion communicating with the hollow screw 115 serves as a return passage 213. A return passage 212 extends perpendicularly from the return passage 213.

The nozzle body 101 has a vertical hole 103 extending along an axis "C" of the fuel injector 1 and communicating with the fuel injection hole 102. A needle valve 105, opening or closing the fuel injection hole 102, is provided in the vertical hole 103. An upper half of the needle valve 105 is slidable with respect to the vertical hole 103.

A vertical hole 111, coaxial with the vertical hole 103, extends in the region corresponding to the nozzle holder 108 and the distance piece 106. A circular hole 112, larger in diameter than the vertical hole 111, is formed on an upper surface of the nozzle holder 108 at a portion corresponding to the open end of the vertical hole 111. The circular hole 112 accommodates a lower plate 117 and an upper 118 each having a diameter smaller than an inner diameter of the circular hole 112. The lower plate 117 closes the open end of the vertical hole 111.

A solenoid cover 122 houses the plates 117 and 118 together with the valve parts of the electromagnetic valve 1*a*, including a valve body 123. The solenoid cover 122 has a screwed portion engaged with a corresponding screwed portion of the nozzle holder 108. The circular hole 112, the plates 117 and 118, and the valve body 123 cooperatively define a ring space 207 serving as a ring passage which communicates with the return passage 212.

A piston 119, provided in the vertical hole 111, has a larger-diameter portion 119*a* at an upper part thereof and a smaller-diameter portion 119*b* at a lower part thereof. The larger-diameter portion 119*a* is slidably brought into contact with the vertical hole 111. A spring 120 is provided around the smaller-diameter portion 119*b*. The needle valve 105 is resiliently urged downward by the spring 120 via the piston 119. Thus, the valve opening of the needle valve 105 is closed. The larger-diameter portion 119*a* and the smaller-diameter portion 119*b* are separate parts which are connected after the smaller-diameter portion 119*b* is inserted into the spring 120. The piston 119 thus assembled with the spring 120 is installed in the nozzle holder 108.

A control chamber 121 is provided above the piston 119. The upper end surface of the piston 119, the vertical hole 111, and the lower end surface of the plate 117 define the wall of control chamber 121.

Next, the fuel passage of the fuel injector 1 will be explained. The inlet passage 201 bifurcates at a terminal end of the inlet portion 109 into two passages 202 and 203. The passage 202 extends downward and reaches the fuel injection hole 102 of the nozzle body 101. Both the injection fuel and the open-and-close control fuel are supplied through this passage 202. An injection chamber 104, formed at a predetermined position of the passage 202, encircles a tapered recess 105*a* of the needle valve 105. When the needle valve 105 receives the hydraulic pressure of the injection chamber 104, the valve opening of the needle valve 105 is opened.

Next, the fuel passage for the fuel introduced from the inlet passage 201 and returned to the return passage 213 will be explained. The passage 203, branching from the inlet passage 201, extends upward and communicates with the control chamber 121 via a restrictor 204. The control chamber 121 communicates with the valve opening 124 of the electromagnetic valve 1*a* via a fuel discharge passage 205 which extends upward across the plates 117 and 118 serving as the ceiling of the control chamber 121.

The valve opening 123 is defined by a valve seat 126 formed at an upper end of the passage 205 and a ball 127 serving as a valve member disposed in a valve chamber 125. The ball 127 is held by a shaft 128 that is slidable along the axis "C" in an up-and-down direction.

A reversed V-shaped passage 206, formed in the valve body 123, has one end communicating with the valve chamber 125. The other end of the reversed V-shaped passage 206 opens at a ceiling surface of the ring passage 207. The reversed V-shaped passage 206 and the ring passage 207 cooperatively form a switching leak passage 2*a*. When the valve opening 124 is opened, the fuel flows through the switching leak passage 2*a* to the return passages 212 and 213.

Both the hydraulic pressure of the control chamber 121 and the resilient force of the spring 120 act on the needle valve 105 as a summed depression force for depressing the needle valve 105 downward. The hydraulic pressure of the injection chamber 104 acts on the needle valve 105 as a lift force for lifting the needle valve 105 upward. When the valve opening 124 is closed, the hydraulic pressure of the control chamber 121 is increased to a high level so that the depression force becomes larger than the lifting force. The needle valve 105 moves downward. When the valve opening 124 is opened, the hydraulic pressure of the control chamber 121 is decreased to a low level so that the depression force becomes smaller than the lifting force. The needle valve 105 moves upward.

The up-and-down movement of the shaft 128 controls contact and separation between the ball 127 and the valve seat 126 which cooperatively define the valve opening 124. A push rod 131, extending along the axis "C", is provided above the shaft 128. A spring 130, housed in a spring chamber 129, resiliently urges the shaft 128 downward (i.e., in the valve closing direction) via the push rod 131.

A circular armature 133, housed in an armature chamber 132, is coaxially coupled with the shaft 128. The armature 133 has a plurality of through holes 134 angularly spaced at equal intervals, for reducing the resistance of fuel when the armature 133 moves in the up-and-down direction. A solenoid 135, comprising a circular core 136 with a coil 137 wound around this core 136, opposes the armature 133. When the solenoid 135 is activated in response to a signal fed from the ECU 8 (refer to FIG. 2), the solenoid 135 magnetically attracts the armature 133. Thus, the shaft 128, coupled with the armature 133, is lifted upward against the resilient force of the spring 130. Accordingly, activation of the solenoid 135 opens the valve opening 124 to decrease the hydraulic pressure of the control chamber 121. The needle valve 105 lifts upward, starting the injection of fuel. On the other hand, deactivation of the solenoid 135 closes the valve opening 124 to increase the hydraulic pressure of the control chamber 121. The needle valve 105 moves downward to stop the fuel injection.

The fuel leaking from the slide portions of the needle valve 105 and the piston 119 flows in the stationary leak passage 2*b*. A passage 208, extending in the up-and-down direction across the nozzle holder 108 and the plates 117 and 118, serves as an upstream portion of the stationary leak passage 2*b*. One end of the upstream portion 208 communicates with a housing 111*a* of the spring 120 formed in the vertical hole 111 to return the fuel leaking from the slide portions of the needle valve 105 and the piston 119. The other end of the upstream portion 208 opens to a bottom surface of the armature chamber 132 via a bottom 113*a* of the deep hole 113 of the return portion 110.

A downstream portion 2*b* 1 of the stationary leak passage 2*b* is a portion extending from the armature chamber 132 to the ring passage 207. The ring passage 207 serves as a merging portion to the switching leak passage 2*a*. More specifically, the armature chamber 132 communicates via passage 209 with a ring passage 210 formed along an inner periphery of the solenoid cover 122. The ring passage 210 communicates with the ring passage 207 via a reversed L-shaped passage 211 formed in the valve body 123.

A ring passage 215, formed along the inner periphery of the solenoid cover 122, is located above the ring passage 210 so as to communicate with this ring passage 210. The ring passage 215 communicates with the spring chamber 129 via a passage 214. The fuel leaks from the slide portion of the push rod 131 to the spring chamber 129 and flows through the passage 214 and the ring passage 215 into the ring passage 210.

The armature chamber 132 has a cylindrical member 139 whose diameter is slightly larger than that of the armature 133. The cylindrical member 139 is interposed between the cylindrical holder 138 and the valve body 123. The cylindrical holder 138, coupled around the solenoid 135 so as to hold the outer periphery of the solenoid 135, has inner and outer diameters identical with those of the cylindrical member 139. The lower end surface of the cylindrical holder 138 is flush with the lower end surface of the solenoid 135. Accordingly, the lower end surface of the solenoid 135 is flush with the upper end surface of the cylindrical member 139. The armature chamber 132 has a cylindrical wall defined by the cylindrical member 139, a ceiling defined by the solenoid 135, and a bottom defined by the valve body 123.

Figure 4:
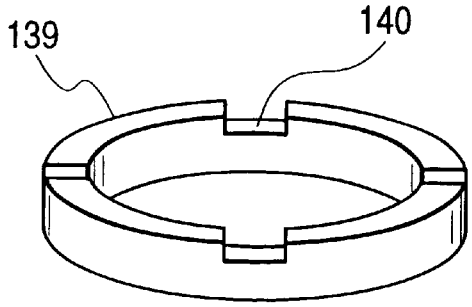
FIG. 4 is a perspective view showing an armature component involved in the fuel injector used in the accumulator fuel injection apparatus in accordance with the first embodiment of the present invention.

FIG. 4 is a perspective view showing the cylindrical member 139. The cylindrical member 139 has a total of four cutout portions 140 formed on a ring surface thereof and spaced symmetrically at equal angularly intervals. When the cylindrical member 139 is installed between the valve body 123 and the cylindrical holder 138, the cutout portions 140 face upward to form four passages 209 which open to an upper portion corresponding to the ceiling 132*a* of the armature chamber 132.

Operation of the above-described fuel injection apparatus will be explained with reference to FIGS. 1 through 4. In the first operation of the fuel injection apparatus performed after installation, the pressurized fuel is introduced into the inlet passage 201 from the common rail 3. The leaking fuel starts flowing in the stationary leak passage 2*b*. The residual air contained in the armature chamber 132 moves to the upper portion of the armature chamber 132. As the downstream portion 2*b*1 of the stationary leak passage 2*b* opens to the ceiling 132*a* of the armature chamber 132, the collected air is discharged out of the armature chamber 132 when the armature chamber 132 is filled with the leaking fuel.

The leaking fuel flows into the armature chamber 132 via the upstream portion 208 of the stationary leak passage 2*b*, and moves upward. The fuel leaking from the slide portions of the needle valve 105 or the like contains few bubbles. In the armature chamber 132, few bubbles are generated. Accordingly, the bubbles quickly exit out of the armature chamber 132 and come to the downstream portion 2*b*1 of the stationary leak passage 2*b* which opens to the ceiling 132*a* of the armature chamber 132.

When the electromagnetic valve 1*a* is opened, the pressurized fuel of the control chamber 121 flows into the valve chamber 125, generating a great amount of bubbles in the vicinity of the valve opening 124. The generated bubbles flow into the return passages 212 and 213 via the switching leak passage 2*a* without passing through the armature chamber 132.

As described in the foregoing description, the armature chamber 132 is free from the influence of the residual air contained during installation as well as the influence of the bubbles generated in the vicinity of the valve opening 124. This realizes stabilized operation of the armature.

Figure 5A:
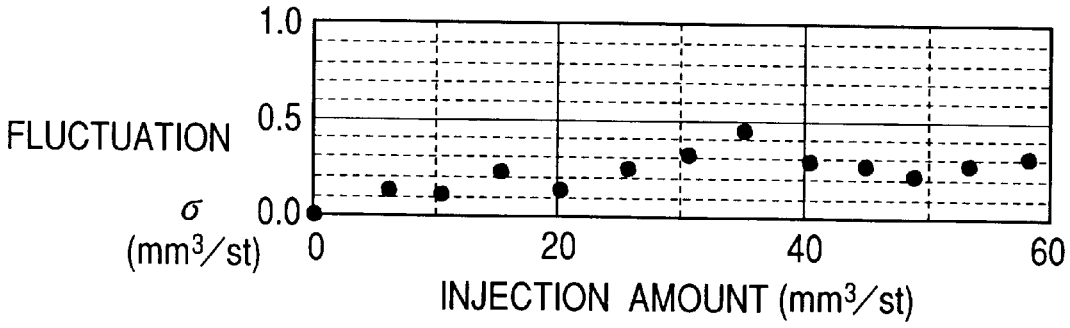
FIG. 5A is a graph showing operation of the accumulator fuel injection apparatus in accordance with the first embodiment of the present invention.
Figure 5B:
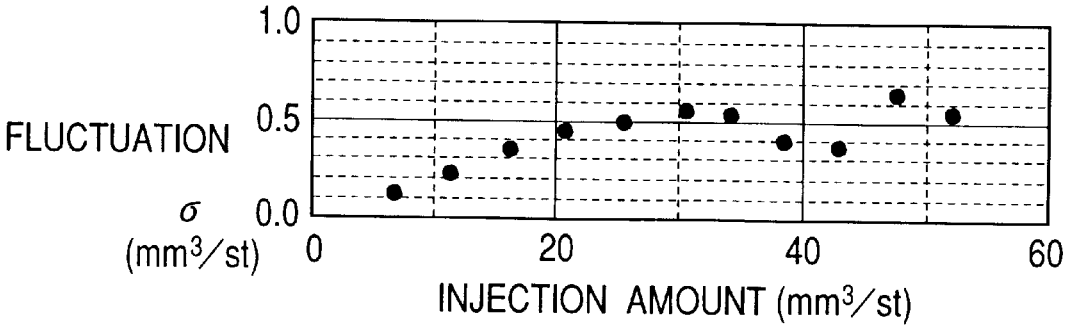
FIG. 5B is a graph showing operation of a comparative conventional accumulator fuel injection apparatus.

FIGS. 5A and 5B are graphs showing the fluctuation of the fuel injection amount with respect to a set value in the accumulator fuel injection apparatus. FIG. 5A shows test result obtained from the fuel injection apparatus in accordance with the present invention, while FIG. 5B shows test result obtained from the conventional fuel injection apparatus. In both cases, the common rail pressure was set to 128 MPa and the control back pressure was set to 40 kPa. As apparent from the test data shown in FIGS. 5A and 5B, it was confirmed that the maximum fluctuation of the fuel injection amount reaches approximately 0.7 $mm^3$/st according to the conventional apparatus but can be suppressed within approximately 0.4 $mm^3$/st in a wide range of the fuel injection amount according to the present invention. This excellent performance is believed to be realized by the characteristic arrangement of the present invention. Namely, the accumulator fuel injection apparatus of the present invention prevents the bubbles generated in the vicinity of the valve opening 124 of the electromagnetic valve 1*a* from directly entering the armature chamber 132. The air contained during installation and the bubbles contained in the leaking fuel are smoothly discharged from the upper portion of the armature chamber 132 without staying in the armature chamber 132. This stabilizes the operation of armature 133.

Although the above-described embodiment discloses four passages 209 between the ring passage 210 and the armature chamber 132, the total number of the passages 209 can be changed flexibly.

According to the above-described embodiment, the downstream portion of the stationary leak passage opens to the wall of the armature chamber. However, it is possible to form a passage in the core of the solenoid so that the downstream portion of the stationary leak passage opens to the lower end of the core. It is desirable that the downstream portion of the stationary leak passage opens closely to the ceiling of the armature chamber as disclosed in the above-described embodiment. However, the opening position may vary depending on the discharge behavior of bubbles or air in the armature chamber. Therefore, it may be possible to set the opening position at a position slightly lower than the ceiling when the bubbles or air can be smoothly discharged to the downstream portion of the stationary leak passage.

Figure 6:
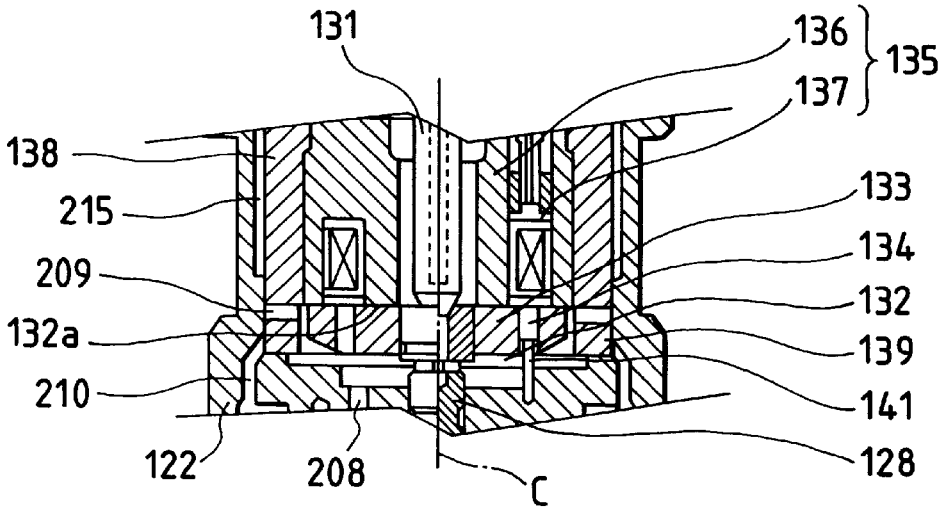
FIG. 6 is a vertical cross-sectional view showing an essential arrangement of a modified fuel injector used in the accumulator fuel injection apparatus in accordance with the first embodiment of the present invention.

Reducing the variation in the lift amount of the ball 127 is important to realize accurate engine control. To this end, rotation of the armature 133 needs to be suppressed. For example, as shown in FIG. 6, it is possible to provide a pin 141 protruding from the bottom of the armature chamber 132. The pin 141 has a diameter slightly smaller than that of the through holes 134 of the armature 133 so as to be engageable with one of the through holes 134.

Both the ceiling 132*a* of the armature chamber 132 and the upper end surface of the armature 133 are normal to the axis "C" in design, however their actual positions may be slightly deviated from the designed positions due to insufficient accuracy in the installation. This deviation causes the armature 133 to gradually rotate about the axis "C" while the armature 133 repetitively reciprocates in the up-and-down direction. Accordingly, when the armature 133 is dislocated with a predetermined angle, the periphery of the armature 133 may hit the ceiling 132*a* of the armature chamber 132. As a result, the lift amount of the ball 127 possibly varies. However, providing the pin 141 makes it possible to prevent the armature 133 from rotating and, accordingly, the lift amount of the ball 127 is stabilized.

Second Embodiment

Figure 7:
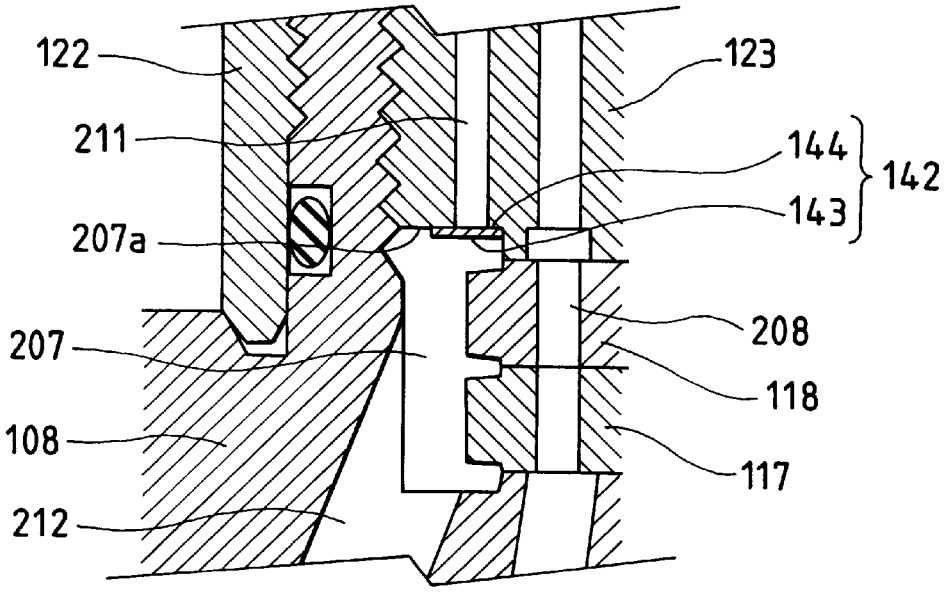
FIG. 7 is a vertical cross-sectional view showing an essential arrangement of a fuel injector in accordance with a second embodiment of the present invention, employed in the accumulator fuel injection apparatus shown in FIG. 2.

FIG. 7 shows an essential arrangement of the second embodiment which can be added to the above-described arrangement of the first embodiment shown in FIGS. 1 through 4. The arrangement of the second embodiment is effective to reduce the influence of the bubbles. Components identical with those shown in FIGS. 1 through 4 are denoted by the same reference numerals. In FIG. 7, the ring passage 207 has a check valve 142 provided at an open end of the ring passage 207. The check valve 142 comprises a resiliently deflectable thin plate 143 made of a metal or a resin which is provided on a ceiling surface 207*a* of the ring passage 207 for closing the opening of the passage 211. One side of the thin plate 143 is securely fixed to the ceiling surface 207*a* by welding. An opening periphery 144 of the passage 211 serves as a valve seat of the check valve 142. The thin plate 143 serves as a valve body.

The fuel flowing from the passage 211 to the ring passage 207 causes the thin plate 143 to resiliently deflect about the fixed side. The deflected portion of the thin plate 143 separates from the ceiling surface 207*a* so as to open the valve opening of the check valve 142. On the other hand, the fuel flowing from the ring passage 207 to the passage 211 causes the thin plate 143 to hermetically contact with the ceiling surface 207*a* so as to close the valve opening of the check valve 142.

The bubbles may be generated in the vicinity of the valve opening 124 of the electromagnetic valve 1*a*. However, providing the check valve 142 makes it possible to eliminate the reverse flow of the bubbles directing from the ring passage 207 to the armature chamber 132. The ring passage 207 is the merging portion to the switching leak passage 2*a*. The armature chamber 132 is located upstream of the passage 211. Thus, the second embodiment makes the armature chamber 132 completely free from the influence of the bubbles.

Although the above-described embodiment discloses the check valve 142 provided in the ring passage 207, it is possible to provide the check valve 142 somewhere in the downward portion 2*b*1 of the stationary leak passage 2*b*.

Needless to say, the check valve disclosed in the above-described embodiment can be replaced by any other comparable valve.

Third Embodiment

Figure 8:
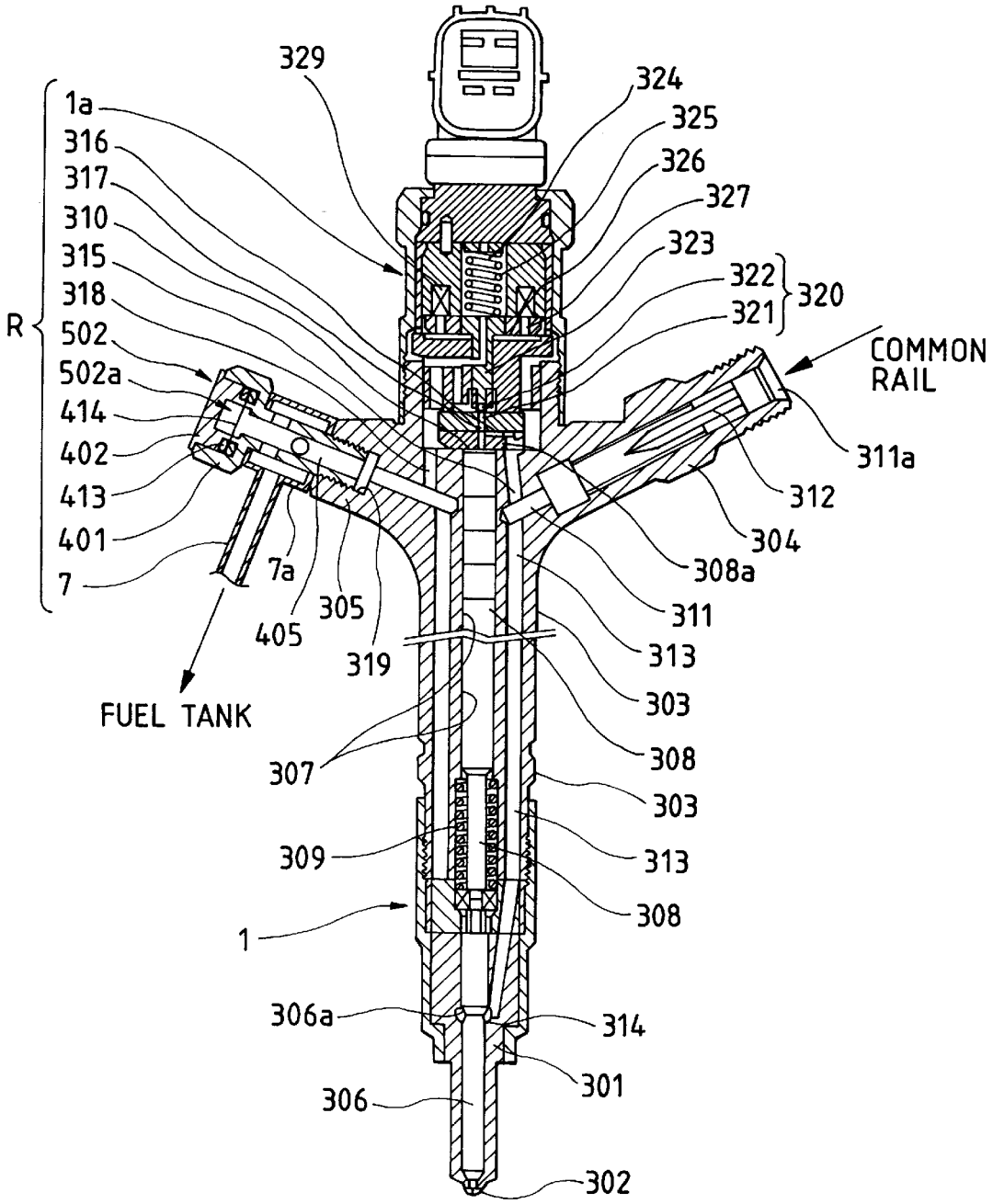
FIG. 8 is a vertical cross-sectional view showing an overall arrangement of a fuel injector in accordance with a third embodiment of the present invention, employed in the accumulator fuel injection apparatus shown in FIG. 2.

FIG. 8 is a vertical cross-sectional view showing an overall arrangement of the fuel injector 1 in accordance with a third embodiment of the present invention, employed in the accumulator fuel injection apparatus shown in FIG. 2.

As shown in FIG. 8, the fuel injector 1 comprises a nozzle body 301 having a fuel injection hole 302 opened at the distal end thereof, and a rodlike nozzle holder 303 holding the nozzle body 301. An electromagnetic valve 1*a*, determining fuel injection and shutoff periods, is provided above the nozzle holder 303. The electromagnetic valve 1*a* opens or closes its valve opening in response to a control signal supplied from the ECU 8 (refer to FIG. 2).

The nozzle holder 303 has an inlet portion 304 and a return portion 305 each extending obliquely upward. The inlet portion 304 is connected to the common rail 3 (refer to FIG. 2). The return portion 305 is engaged with a hollow screw 502 at their screw portions. The hollow screw 502 serves as a connection member for connecting the return portion 305 and the return pipe 7 (refer to FIG. 2). A swivel fitting 7*a*, constituting part of the return pipe 7, is connected to the return portion 305 together with the hollow screw 502.

The hollow screw 502 is a characteristic portion of the present invention. Before explaining details of the hollow screw 502, the fuel injector 1 will be explained in more detail.

A needle valve 306, opening or closing the fuel injection hole 302, is slidably accommodated in the nozzle body 301. A piston 308, disposed above the needle valve 306, is slidable in a guide hole 307 formed in the nozzle holder 303. The needle valve 306 is resiliently urged downward by a spring 309 via the piston 308. Thus, the valve opening of the needle valve 306 is closed. A control chamber 310 is formed above the piston 308. An upper end surface 308*a* of the piston 308 constitutes a wall of the control chamber 310 shiftable in the up-and-down direction.

An inlet passage 311, formed in the inlet portion 304, has an inlet opening 311*a* provided at the distal end of the inlet portion 304 for introducing the pressurized fuel of the common rail 3. A bar filter 312 is provided in this inlet passage 311 at a portion downstream of the inlet opening 311*a*. The bar filter 312 removes foreign substances contained in the accumulated fuel introduced from the common rail 3.

The inlet passage 311 bifurcates at a terminal end of the inlet portion 304 into two passages 313 and 315. The passage 313 extends downward and reaches the fuel injection hole 302 of the nozzle body 301. An injection chamber 314, formed at a predetermined position of the passage 313, encircles a tapered recess 306*a* of the needle valve 306. When the needle valve 306 receives the hydraulic pressure of the injection chamber 314, the valve opening of the needle valve 306 is opened.

The passage 315, branching from the inlet passage 311, extends upward and communicates with the control chamber 310 via a restrictor 316. Both the hydraulic pressure of the control chamber 310 and the resilient force of the spring 309 act on the needle valve 306 as a summed depression force for depressing the needle valve 306 downward. The hydraulic pressure of the injection chamber 314 acts on the needle valve 306 as a lift force for lifting the needle valve 306 upward. When the hydraulic pressure of the control chamber 310 is increased to a high level, the depression force becomes larger than the lifting force. The needle valve 306 moves downward. When the hydraulic pressure of the control chamber 310 is decreased to a low level, the depression force becomes smaller than the lifting force. The needle valve 306 moves upward.

A passage 317 is formed above the control chamber 310. The control chamber 310 communicates with a return passage 318 via this passage 317 and the electromagnetic valve 1*a*. The return passage 318 is connected to a bottom of a hollow screw installation hole 319 formed in the return portion 305. Part of the accumulated fuel introduced from the inlet portion 304 returns to the fuel tank 5 (refer to FIG. 2) of low-pressure via a return passage R consisting of the passage 315, the restrictor 316, the control chamber 310, the passage 317, the electromagnetic valve 1*a*, the return passage 318, the hollow screw 502, and the return pipe 7.

The valve opening 320 of the electromagnetic valve 1*a* is defined by a valve seat 321 formed at an upper end of the passage 317 and a ball 322 serving as a valve member. The return passage 318 communicates with a spring chamber 324 accommodating a spring 325 therein. The spring 325 resiliently urges the ball 322 downward (i.e., in the valve closing direction) via the push rod 323. A circular armature 327, housed in an armature chamber 326, is coaxially coupled with the upper end of push rod 323. The armature chamber 326 communicates with the return passage 318.

A solenoid 329, provided above the armature 327, opposes the armature 327. When the solenoid 329 is activated in response to a signal fed from the ECU 8 (refer to FIG. 2), the solenoid 329 magnetically attracts the armature 327. Thus, the push rod 323, coupled with the armature 327, is lifted upward against the resilient force of the spring 325. Accordingly, activation of the solenoid 329 opens the valve opening 320 to decrease the hydraulic pressure of the control chamber 310. The needle valve 306 lifts upward, starting injection of fuel. On the other hand, deactivation of the solenoid 329 closes the valve opening 320 to increase the hydraulic pressure of the control chamber 310. The needle valve 306 moves downward to stop the fuel injection.

Figure 9A:
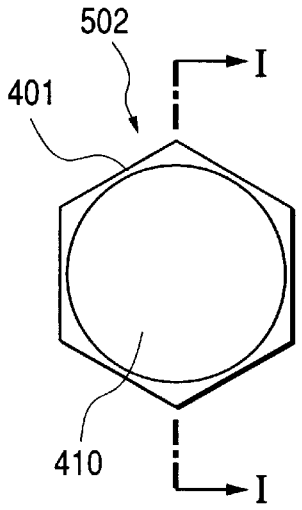
FIG. 9A is a front view showing a hollow screw used in the accumulator fuel injection apparatus in accordance with the third embodiment of the present invention.
Figure 9B:
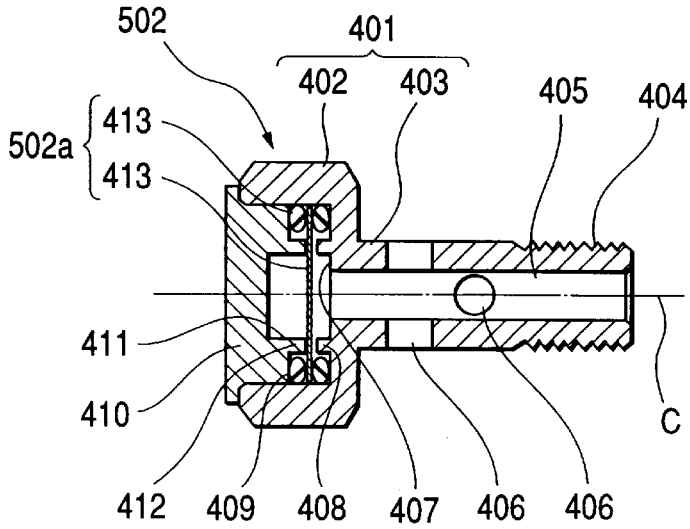
FIG. 9B is a cross-sectional view taken along a line I—I of FIG. 9A.

The hollow screw 502, as a characteristic part of the present invention, will be explained. FIG. 9A is an enlarged front view showing the hollow screw 502, and FIG. 9B is an enlarged cross-sectional view of the hollow screw 502 taken along a line I—I of FIG. 9A. The hollow screw 502 has a housing 401 opened at both ends. One open end of the housing 401 is closed by a cap 410 so as to define a chamber accommodating a damper element 502*a*.

The housing 401 is a cylindrical iron body configured into a bolt-like stepped tube consisting of a larger-diameter head 402 and a smaller-diameter shaft 403. The iron cap 410 is engaged with an opening of the head 402. An outer periphery of the head 402 is hexagonal. A screw portion 404 is formed on an outer surface of an opposite end of the shaft 403. The hollow screw 502 is assembled with the swivel fitting 7*a* and fixed to the return portion 305 (refer to FIG. 8) at the screw portion 404. The inside space of the housing 401 serves as a return passage 405 communicating with the return passage 318 of the fuel injector 1. A total of four through holes 406 are provided on the cylindrical wall of the shaft 403. The swivel fitting 7*a* encircles the shaft 403 so that the return passage 405 communicates with the return pipe 7.

Two pairs of through holes 406 are provided at symmetrical positions on the cylindrical housing 401 corresponding to radial lines crossing normal to each other. The fuel, returning from the fuel injector 1, uniformly flows in the return passage 405. These two pairs of through holes 406 are offset in a direction of the axis "C" of the cylindrical housing 401. With this axial offset arrangement of the through holes 406, the opened or lightened portions are adequately separated in the axial direction. Thus, the strength of the housing 401 is maintained at a sufficient value.

The cap 410 has a circular recess 411 facing the return passage 405. A ring ridge 412 is formed along a cylindrical periphery of the circular recess 411. A ring ridge 408, substantially identical with the ring ridge 412, is formed on an inside stepped surface 407 of the housing 401 so as to oppose the ring ridge 412.

The damper element 502*a*, disposed between the housing 401 and the cap 410, comprises two rubber O-rings 413 accommodated in a ring space defined by the ring ridges 408 and 412 and an inner cylindrical surface 409.

A circular plate 414, serving as a pressure-receiving plate, is sandwiched between two rubber O-rings 413. The circular plate 414 is a thin stainless steel plate having a thickness of approximately 0.1 mm. The diameter of the circular plate 414 is slightly smaller than the inner diameter of the head 402 of the housing 401. The circular plate 414 hermetically contacts with the O-rings 413 at the peripheral edge thereof. The circular plate 414 is disposed normal to the axis "C" of the housing 401 so as to close the open end of the housing 401. The plate 414 is resiliently deflectable in the direction of the axis "C" toward the cap 410 in response to an increased hydraulic pressure of the fuel flowing in the return passage 405.

The O-ring 413 elastically deforms in accordance with an advancing depth of the cap 410 into the housing 401. To surely suppress the fuel leakage, it is preferable to leave a margin in the elastic deformation of the O-ring 413 so that the O-ring 413 can elastically deform in response to the increased fuel pressure of the return passage 405. An overall deflection amount of the plate 414 is substantially increased by the deformation of the O-ring 413. In other words, the plate 414 can be made of a relatively strong or thick material.

In the assembling of the hollow screw 502, the plate 414 put between two O-rings 413 is placed in the recess of the head 402. Then, the cap 410 is press-fitted into the opening of the head 402. Thereafter, the housing 401 and the cap 410 are completely fixed by welding. A relatively low-temperature welding method, such as argon welding, is preferable because the rubber O-ring 413 is not deteriorated.

Operation of the above-described accumulator fuel injection apparatus will be explained with reference to FIGS. 2, 8, 9A and 9B. To start the fuel injection, the ECU 8 activates the solenoid 329. In response to the activation of the solenoid 329, the needle valve 306 lifts upward, starting the fuel injection.

When a predetermined fuel injection period of time has passed, the ECU 8 deactivates the solenoid 329.

According to the conventional fuel injection apparatus, operation of the electromagnetic valve is unstable during the valve closing operation, causing undesirable bounce of the needle valve. However, according to the present invention, the hollow screw 502 has the damper element 502*a* comprising the plate 414 and the O-rings 413. When received an increased hydraulic pressure of the fuel flowing in the return passage 405, the plate 414 deflects toward the cap 410. The volume of the return passage 405 increases in proportion to a deflection amount of the plate 414. Accordingly, the volume of a portion of the return passage R, extending from the electromagnetic valve 1*a* to the return passage 405, increases so as to cancel the increased fuel pressure. Thus, the damper element 502*b* eliminates the fluctuation of the fuel pressure in the armature chamber 326 of the electromagnetic valve la. The needle valve 306 surely closes its valve opening in response to the termination of the fuel injection period of time, holding the seated condition without causing any undesirable valve bouncing behavior.

According to the above-described embodiment, the damper element 502*a* is accommodated in the hollow screw 502 which is located just downstream of the electromagnetic valve 1*a*. Thus, the damper element 502*a* can operate quickly in response to the change of the fuel pressure. Furthermore, the plate 414 is normal to the axis "C" corresponding to the flow direction of the fuel in the return passage 405. Thus, the plate 414 deflects in the same direction as the fuel flow direction, effectively canceling the increase of the fuel pressure.

Figure 10:
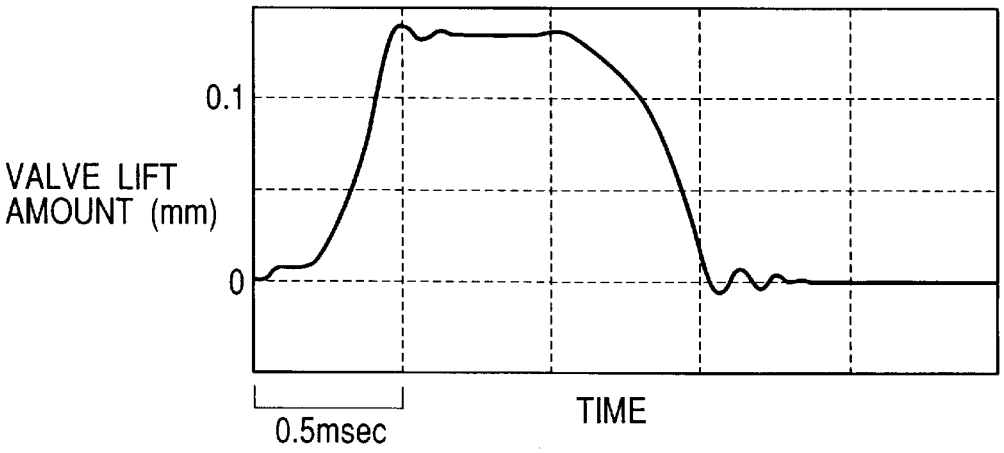
FIG. 10 is a time chart showing a valve lift behavior of the accumulator fuel injection apparatus in accordance with the third embodiment of the present invention.
Figure 14:
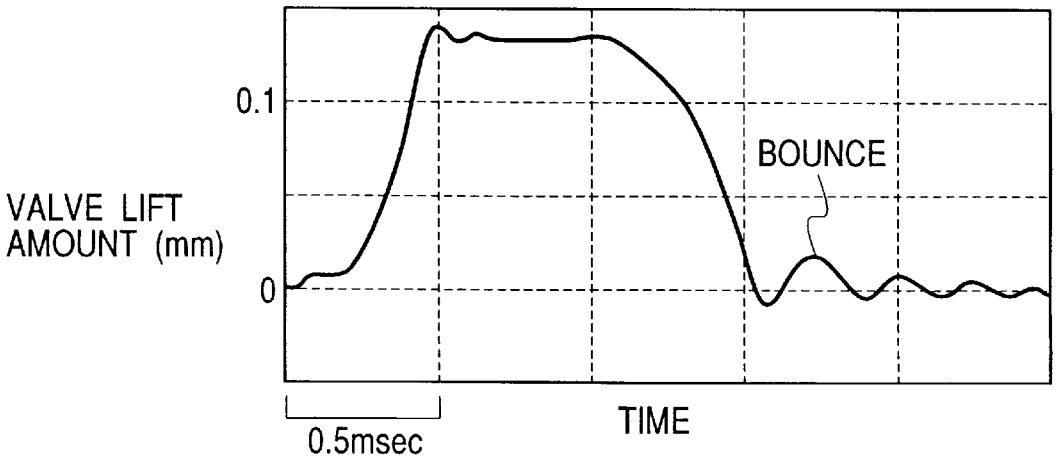
FIG. 14 PRIOR ART
FIG. 14 is a time chart showing a valve lift behavior of a conventional accumulator fuel injection apparatus.

FIG. 10 shows a valve lift behavior of the above-described accumulator fuel injection apparatus, according to which the valve bouncing behavior responsive to the valve closing operation is substantially eliminated. When compared with FIG. 14 that shows the valve lift movement of the conventional accumulator fuel injection apparatus, the difference is apparent. Thus, the present invention can provide an accumulator fuel injection apparatus capable of performing accurate engine controls.

Furthermore, the hollow screw 502 of the present invention can be installed into the fuel injector 1 in the same manner as a conventional one having no damper element. The hollow screw 502 of the present invention is substantially the same in outer configuration as that of the conventional one. No modification is required in the design of the accumulator fuel injection apparatus. The above-described valve bouncing elimination can be realized at low cost.

Fourth Embodiment

Figure 11A:
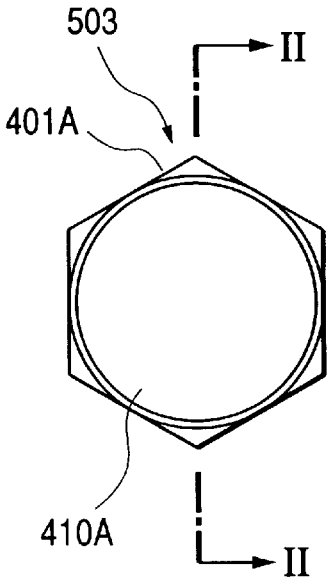
FIG. 11A is a front view showing a hollow screw used in the accumulator fuel injection apparatus in accordance with a fourth embodiment of the present invention.
Figure 11B:
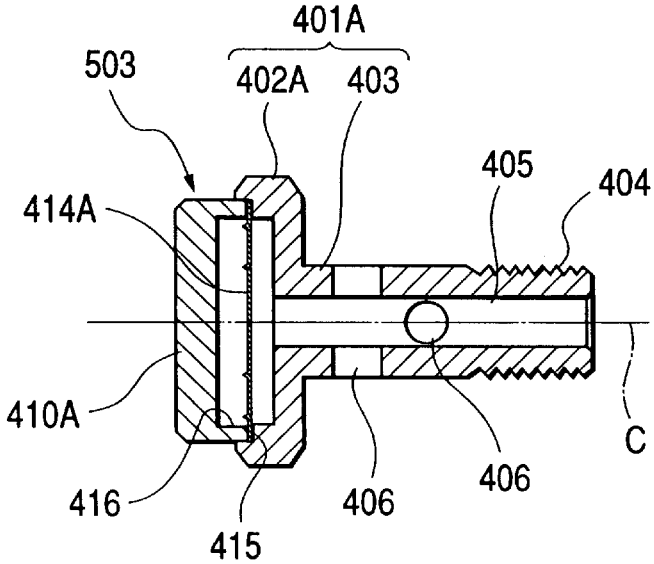
FIG. 11B is a cross-sectional view taken along a line II—II of FIG. 11A.

The hollow screw 502 disclosed in the third embodiment can be replaced by a hollow screw 503 shown in FIGS. 11A and 11B. Components identical with those disclosed in FIGS. 9A and 9B are denoted by the same reference numerals. Difference between the third embodiment and the fourth embodiment will be chiefly explained hereinafter.

A housing 401A has a head 402A with a circular recess. A stepped portion 415 is formed along an inner cylindrical wall of the head 402A, so that an inner diameter of the circular recess slightly increases at the stepped portion 415. The cap 410A is inserted into the radially enlarged portion of the circular recess. The cap 410A has a recess 416 having substantially the same inner diameter as that of a non-enlarged portion of the circular recess formed in the head 402A.

A damper element of the second embodiment is constituted by a pressure-receiving plate 414A only. A ring edge surface of the cap 410A opposes the surface of the stepped portion 415 formed in the circular recess of the head 402A of the housing 401A. No O-ring is used to hold the plate 414A between the ring edge surface of the cap 410A and the stepped portion 415 of the housing 401A. The plate 414A serves as a wall of the return passage 405.

Figure 12A:
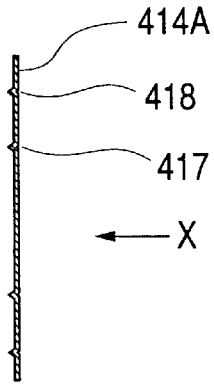
FIG. 12A is an enlarged across-sectional view showing a pressure-receiving plate accommodated in the hollow screw shown in FIG. 11B.
Figure 12B:
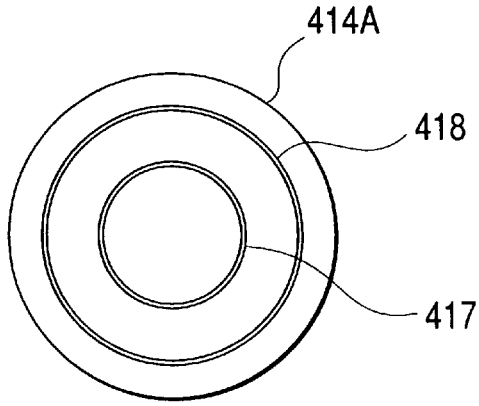
FIG. 12B is a front view showing the pressure-receiving plate seen from an arrow X of FIG. 12A.

FIG. 12A is an enlarged cross-sectional view showing the plate 414 of FIG. 11B. FIG. 12B is a front view of the plate 414 seen from an arrow X shown in FIG. 12A. The plate 414A is a circular thin stainless steel plate having a thickness of approximately 60 82 m. Two, small and large, circular embossed ridges 417 and 418 are formed on the surface of the circular plate 414A, coaxially about the center of the circular plate 414A. The plate 414A is elastically deformable at the embossed ridges 417 and 418. When the plate 414A is installed between the cap 410A and the housing 401A, the plate 414A faces the return passage 405 at its recessed side opposed to the raised pattern of the embossed ridges 417 and 418.

In the assembling of the hollow screw 503, the plate 414A is placed in the head 402A of the housing 401A. Then, the cap 410A is press-fitted into the opening of the head 402A. Thereafter, the housing 401A and the cap 410A are hermetically fixed along their cylindrical contact portions by brazing. The brazing is preferably used when no rubber member is used.

Figure 13:
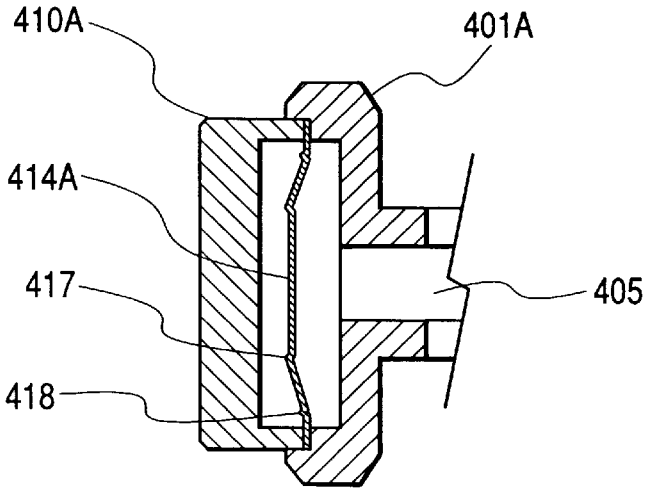
FIG. 13 is a cross-sectional view showing operation of the hollow screw shown in FIG. 11B.

According to the above-described arrangement, as shown in FIG. 13, the plate 414A deflects at its embossed ridges 417 and 418 in response to the increased hydraulic pressure of the fuel flowing in the return passage 405 during the valve closing operation. The center of the plate 414A shifts toward the cap 410A. The volume of the return passage 405 increases in proportion to a deflected amount of the plate 414A. Accordingly, in the same manner as in the third embodiment, the valve bouncing behavior can be surely prevented.

The position of the through holes formed on the hollow screw and the total number thereof can be adequately changed unless operation of the damper element is worsened.

The above-described pressure-receiving plate deflects in response to the increased fuel pressure so as to increase the substantial volume of the return passage. However, in the arrangement of FIG. 9B, it is possible to use O-rings capable of causing a large elastic deformation in response to the increased fuel pressure so that the pressure-receiving plate moves backward in accordance with the elastic deformation of the O-rings. Alternatively, it may be possible to remove the pressure-receiving plate when any other arrangement for canceling the increased fuel pressure is adopted.

The installation position of the damper element is not limited in the hollow screw. The damper element can be placed somewhere in the return passage downstream of the electromagnetic valve, including the return pipe and the inside space of the fuel injector. It is preferable to locate the damper element closely to the electromagnetic valve. However, the installation position of the damper element can be adequately determined according to an allowable level of the valve bouncing behavior.

Fifth Embodiment

Figure 15:
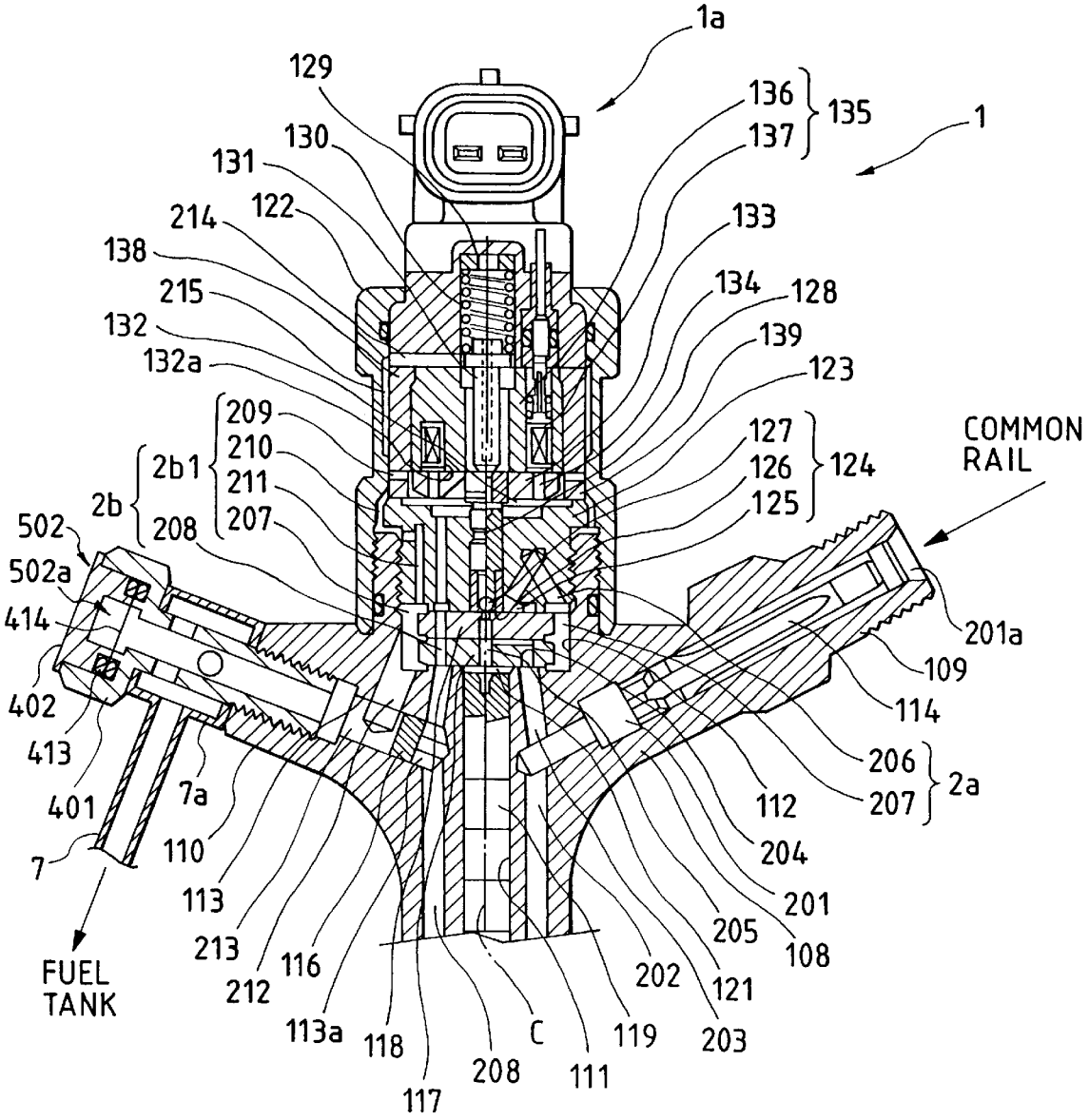
FIG. 15 is a vertical cross-sectional view showing an essential arrangement of a fuel injector in accordance with a fifth embodiment of the present invention, employed in the accumulator fuel injection apparatus shown in FIG. 2.

FIG. 15 is a vertical cross-sectional view showing an essential arrangement of a fuel injector 1 in accordance with a fifth embodiment of the present invention, employed in the accumulator fuel injection apparatus shown in FIG. 2. The fuel injector 1 according to the fifth embodiment is substantially the combination of essential structures of the above-described first and third embodiments. More specifically, the hollow screw 115 of the first embodiment is replaced by the hollow screw 502 of the third embodiment. The fifth embodiment can realize the effects of the above-described first and third embodiments.

This invention may be embodied in several forms without departing from the spirit of essential characteristics thereof. The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. An accumulator fuel injection apparatus comprising:

a fuel injector;

an accumulator pipe for supplying pressurized fuel to the fuel injector;

a control chamber for open-and-close controlling a needle valve that determines injection and shutoff periods of the fuel injector;

an electromagnetic valve for adjusting a hydraulic pressure of the control chamber, said electromagnetic valve including an armature accommodated in an armature chamber into which fuel is introduced; and stabilizing means provided for stabilizing behavior of fuel introduced in said armature chamber.

2. An accumulator fuel injection apparatus comprising:

a fuel injector;

an accumulator pipe for supplying pressurized fuel to the fuel injector;

a control chamber for open-and-close controlling a needle valve that determines injection and shutoff periods of the fuel injector;

an electromagnetic valve for adjusting a hydraulic pressure of the control chamber; and stabilizing means provided for stabilizing behavior of the fuel used to control the fuel injector, wherein the electromagnetic valve comprises an armature driven by a solenoid to open-and-close control a valve opening of the electromagnetic valve, the armature is accommodated in an armature chamber into which the fuel is introduced, and the stabilizing means is a passage for discharging bubbles or residual air from the armature chamber.

3. The accumulator fuel injection apparatus in accordance with claim 1, wherein the stabilizing means is a damper element provided in a return passage which returns part of the pressurized fuel from the fuel injector to a fuel tank via a return pipe, and the damper element is provided at a portion downstream of the electromagnetic valve for suppressing increase in a hydraulic pressure of fuel flowing in the return passage.

4. An accumulator fuel injection apparatus for supplying accumulated fuel from an accumulator pipe to a fuel injector, the fuel injector comprising:

a control chamber into which part of the accumulated fuel is introduced to open-and-close control a needle valve according to a hydraulic pressure of the introduced fuel, the needle valve determining injection and shutoff periods of the fuel injector, an electromagnetic valve for opening and closing a fuel discharge passage of the control chamber to adjust a hydraulic pressure in the control chamber, a switching leak passage for returning discharged fuel from a valve opening of the electromagnetic valve to a low-pressure return passage, and a stationary leak passage for returning fuel leaking from slide portions of the fuel injector to the low-pressure return passage, and the electromagnetic valve comprising an armature chamber for accommodating an armature driven by a solenoid to open-and-close control the valve opening of the electromagnetic valve, so that the fuel is introduced into the armature chamber, wherein the switching leak passage directly connects the valve opening of the electromagnetic valve and the low-pressure return passage, the armature chamber is provided in the stationary leak passage, and a downstream portion of the stationary leak passage positioned downstream of the armature chamber communicates with an upper portion of the armature chamber.

5. The accumulator fuel injection apparatus in accordance with claim 4, wherein the downstream portion of the stationary leak passage is connected to an opening provided at a height corresponding to a ceiling of the armature chamber.

6. The accumulator fuel injection apparatus in accordance with claim 4, wherein the stationary leak passage has a check valve provided between the armature chamber and a merging portion to the switching leak passage for limiting flow of the fuel in a single direction directing from the armature chamber to the merging portion.

7. An accumulator fuel injection apparatus comprising:

a fuel injector;

an accumulator pipe for supplying pressurized fuel to the fuel injector;

a return passage for returning part of the pressurized fuel from the fuel injector to a fuel tank via a return pipe;

a control chamber provided in the return passage for open-and-close controlling a needle valve that determines injection and shutoff periods of the fuel injector; and an electromagnetic valve provided downstream of the control chamber for controlling communication and isolation between the control chamber and the return pipe, said electromagnetic valve including an armature accommodated in an armature chamber, wherein a damper element is provided in the return passage at a portion downstream of the electromagnetic valve for stabilizing behavior of the fuel introduced in said armature chamber, thereby suppressing an increase in a hydraulic pressure of fuel flowing in the return passage.

8. The accumulator fuel injection apparatus in accordance with claim 7, wherein the damper element comprises a pressure-receiving plate facing the return passage and retractable in response to the increase of hydraulic pressure of the fuel flowing in the return passage.

9. The accumulator fuel injection apparatus in accordance with claim 7, wherein the damper element is accommodated in a connection member connecting the fuel injector and the return pipe, and the connecting member constitutes part of the return passage.

10. The accumulator fuel injection apparatus in accordance with claim 9, wherein the connection member comprises a cylindrical housing connected to the fuel injector at one end, the cylindrical housing has at least one through hole formed on a cylindrical wall thereof for communicating an inside space of the cylindrical housing with the return pipe, the damper element comprises a pressure-receiving plate made of a resiliently deflectable thin plate disposed normal to an axis of the cylindrical housing to close the other end of the cylindrical housing.

11. The accumulator fuel injection apparatus in accordance with claim 10, wherein two pairs of through holes are provided at symmetrical positions on the cylindrical housing corresponding to radial lines crossing normal to each other, and the two pairs of through holes are offset in an axial direction of said cylindrical housing.

12. An accumulator fuel injection apparatus for supplying accumulated fuel from an accumulator pipe to a fuel injector, the fuel injector comprising:

a control chamber into which part of the accumulated fuel is introduced to open-and-close control a needle valve according to a hydraulic pressure of the introduced fuel, the needle valve determining injection and shutoff periods of the fuel injector, an electromagnetic valve provided downstream of the control chamber for opening and closing a fuel discharge passage of the control chamber to adjust a hydraulic pressure in the control chamber, a switching leak passage for returning the discharged fuel from a valve opening of the electromagnetic valve to a low-pressure return passage, and a stationary leak passage for returning fuel leaking from slide portions of the fuel injector to the low-pressure return passage, and the electromagnetic valve comprising an armature chamber for accommodating an armature driven by a solenoid to open-and-close control the valve opening of the electromagnetic valve, so that the fuel is introduced into the armature chamber, wherein the switching leak passage directly connects the valve opening of the electromagnetic valve and the low-pressure return passage, the armature chamber is provided in the stationary leak passage, a downstream portion of the stationary leak passage positioned downstream of the armature chamber communicates with an upper portion of the armature chamber, and a damper element is provided in the return passage at a portion downstream of the electromagnetic valve for suppressing increase in a hydraulic pressure of fuel flowing in the return passage.

13. The accumulator fuel injection apparatus in accordance with claim 1, wherein said stabilizing means suppresses change of pressure in said armature chamber.

14. The accumulator fuel injection apparatus in accordance with claim 7, wherein said armature chamber communicates to an intermediate portion between the downstream portion of said electromagnetic valve and said damper element.

15. The accumulator fuel injection apparatus in accordance with claim 1, wherein the stabilizing means is a passage for discharging bubbles or residual air from the armature chamber.

16. The accumulator fuel injection apparatus comprising:

a fuel injector;

an accumulator pipe for supplying pressurized fuel to the fuel injector; a return passage for returning part of the pressurized fuel from the fuel injector to a fuel tank via a return pipe;

a control chamber provided in the return passage for open-and-close controlling a needle valve that determines injection and shutoff periods of the fuel injector; and an electromagnetic valve provided downstream of the control chamber for controlling communication and isolation between the control chamber and the return pipe, wherein a damper element is provided in the return passage at a portion downstream of the electromagnetic valve for suppressing an increase in a hydraulic pressure of fuel flowing in the return passage, wherein the damper element comprises a pressure-receiving plate facing the return passage and retractable in response to an increase in hydraulic pressure of the fuel flowing in the return passage.

* * * * *